US006168693B1

(12) United States Patent
Uzoh et al.

(10) Patent No.: US 6,168,693 B1
(45) **Date of Patent: *Jan. 2, 2001**

(54) APPARATUS FOR CONTROLLING THE UNIFORMITY OF AN ELECTROPLATED WORKPIECE

(75) Inventors: Cyprian Emeka Uzoh, Hopewell Junction; Gerard Raymond Landry, New Windsor, both of NY (US)

(73) Assignee: International Business Machines Corporation, Armonk, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/012,069

(22) Filed: Jan. 22, 1998

(51) Int. Cl.[7] ..... C25B 9/00; C25C 3/20

(52) U.S. Cl. ..... 204/229.4; 204/230.7; 204/DIG. 7

(58) Field of Search ..... 204/DIG. 7, 229.4, 204/230.2, 230.3, 230.7

(56) References Cited

U.S. PATENT DOCUMENTS

| | | | | |
|---|---|---|---|---|
| 4,065,374 | * | 12/1977 | Asami et al. | 204/228 |
| 4,772,369 | * | 9/1988 | Mercier et al. | 204/149 |
| 5,007,993 | | 4/1991 | Hull et al. . | |
| 5,049,246 | | 9/1991 | Hull et al. . | |
| 5,078,852 | | 1/1992 | Yee et al. . | |
| 5,135,636 | | 8/1992 | Yee et al. . | |
| 5,605,615 | * | 2/1997 | Goolsby et al. | 205/83 |
| 5,620,581 | * | 4/1997 | Ang | 205/96 |
| 6,004,440 | * | 12/1999 | Hanson et al. | 204/279 |

FOREIGN PATENT DOCUMENTS

| | | |
|---|---|---|
| 037658 | 10/1979 | (JP) . |
| 060915 | 11/1980 | (JP) . |
| 63-100197 | 5/1988 | (JP) . |

OTHER PUBLICATIONS

Mehdizadeh, S., et al., "Optimization of Electrodeposit Uniformity by the Use of Auxiliary Electrodes," *J. Electrochem. Soc.*, vol. 137, No. 1, Jan. 1990, pp. 110–117.

* cited by examiner

*Primary Examiner*—Kathryn Gorgos
*Assistant Examiner*—Wesley A. Nicolas
(74) *Attorney, Agent, or Firm*—Pollock, Vande Sande & Amernick, R.L.L.P.

(57) ABSTRACT

An electroplating system for plating at least one metal on at least one substrate. At least one plating tank contains a plating solution including the at least one metal to be plated on the at least one substrate. At least one anode is arranged in the at least one plating tank. The at least one anode is at least partially immersed within the plating solution during plating of the at least one metal. At least one cathode includes at least one workpiece portion in contact with the at least one substrate and at least one thief portion arranged in the vicinity of at least one portion of the at least one substrate for controlling plating of the at least one metal on the at least one portion of the at least one substrate. At least one power supply is connected to the at least one cathode. At least one controller separately controls a flow of power to the at least one workpiece portion of the cathode and the at least one thief portion of the cathode.

12 Claims, 5 Drawing Sheets

APPARATUS FOR CONTROLLING THE UNIFORMITY OF AN ELECTROPLATED WORKPIECE

FIELD OF THE INVENTION

The invention relates to the electroplating metal on substrates, a system for electroplating metal on substrates, and control system for controlling electroplating on substrates and a method of electroplating metal on substrates.

BACKGROUND OF THE INVENTION

In the production of microelectronic devices, metal may be plated on a substrate for a variety of purposes. Typically, metal is plated on the substrates in cells or reservoirs that hold a plating solution that includes at least one metal to be plated on the substrate.

In microelectronic device manufacture, it is often desirable for metal to be uniformly deposited across a substrate. In electrodeposition of metals, uniformity of the deposited metals is typically coupled to thickness of the deposited metal. This is particularly so in electrodeposition of metals on thin seed layers. Simultaneous control of deposited metal thickness and uniformity on various thin seed layers is rather difficult.

Typically, for a given thin seed layer thickness, electroplated metal uniformity improves with increasing metal thickness. For example, in copper deposition, for ULSI interconnection, the uniformity of a deposit of about 500 nm is about 13%. This percentage indicates the percentage of standard deviation in metal thickness with respect to average metal thickness over the surface of the substrate. The uniformity for a deposit of about 1,000 nm is about 9% and about 3% for a deposit of about 2,000 nm. The above illustrates the strong connection between metal uniformity and metal thickness.

Lack of uniformity of deposited metal also presents problems in metal damascene processes. In the damascene process, after metal deposition, the metal overburden is planarized to define the interconnection features or structure.

In such cases, good metal uniformity may actually pose a problem. For example, depending upon the nature of polishing pads, arrangements, choice of slurry, pressure table rotation and other polishing parameters, good metal uniformity may not be desirable. For example a 2$\mu$Cu or Al film with the uniformity of 3% may present a problem for polishing.

During chemical-mechanical polishing (CMP) the edges of wafers may tend to clear before the center of a wafer. Premature exposure of the chips at the wafer edge may cause the chips to be overpolished. As a result, the resistance of metal lines near a wafer edge may tend to be higher than the resistance of those further away from the edge.

SUMMARY OF THE PRESENT INVENTION

An object of the present invention is to provide a method and apparatus for controlling uniformity of at least one metal electroplated on a substrate or workpiece.

Accordingly, the aspects of the present invention provide an electroplating system for plating at least one metal on at least one substrate or workpiece. The system includes at least one plating tank containing a plating solution including at least one metal to be plated on the at least one substrate or cathode. At least one anode is arranged in the at least one plating tank. The at least one anode is at least partially immersed within the plating solution during plating of the at least one metal. A cathode assembly includes at least one thief and at least one workpiece portion. In the cathode assembly, the at least one thief portion is arranged in the vicinity of at least one workpiece to be plated. The at least one thief controls plating of the at least one metal on the at least one portion of the at least one substrate. At least one power supply is connected to the at least one cathode. At least one controller separately controls a flow of power to the at least one workpiece portion of the cathode and the at least one thief portion of the cathode.

The present invention also includes a control system for controlling uniformity of at least one metal electroplated on at least one substrate in the electroplating system. The electroplating system includes at least one plating tank containing a plating solution including the at least one metal to be plated on the at least one substrate. At least one anode is arranged in the at least one plating tank. The at least one anode is at least partially immersed within the plating solution during plating of the at least one metal. The system also includes at least one cathode including at least one workpiece portion in contact with the at least one substrate and at least one thief portion arranged in the vicinity of at least one portion of the at least one substrate for controlling plating of the at least one metal on the at least one portion of the at least one substrate. At least one power supply is connected to the at least one cathode. The control system includes at least one controller for separately controlling a flow of power to the at least one workpiece portion of the cathode and the at least one thief portion of the cathode.

Furthermore, aspects of the present invention include a method of electroplating at least one metal on at least one substrate in an electroplating system including at least one plating tank containing a plating solution including the at least one metal to be plated on the at least one substrate. At least one anode is arranged in the at least one plating tank. The at least one anode is at least partially immersed within the plating solution during plating of the at least one metal. The system also includes at least one cathode including at least one workpiece portion in contact with the at least one substrate and at least one thief portion arranged in the vicinity of at least one portion of the at least one substrate for controlling plating of the at least one metal on the at least one portion of the at least one substrate. At least one power supply is connected to the at least one cathode. At least one controller separately controls a flow of power to the at least one workpiece portion of the cathode and the at least one thief portion of the cathode. The method includes controlling a flow of power to the at least one workpiece portion of the at least one cathode. A flow of power to the at least one thief portion of the at least one cathode is controlled separately from the flow of power to the at least one workpiece portion of the at least one cathode.

Still further aspects of the present invention provide a method of electroplating at least one metal on at least one substrate in an electroplating system. The method includes the step of providing an electroplating system including at least one plating tank containing a plating solution including the at least one metal to be plated on the at least one substrate. At least one anode is arranged in the at least one plating tank. The at least one anode is at least partially immersed within the plating solution during plating of the at least one metal. The system also includes at least one cathode including at least one workpiece portion in contact with the at least one substrate and at least one thief portion arranged in the vicinity of at least one portion of the at least one substrate for controlling plating of the at least one metal on the at least one portion of the at least one substrate. At least one power supply is connected to the at least one cathode. At least one controller separately controls a flow of power to the at least one workpiece portion of the cathode and the at least one thief portion of the cathode. The method also includes utilizing the at least one controller to control a flow of power to the workpiece portion of the cathode. Additionally, the method includes utilizing the at least one controller to control a flow of power to the at least one thief portion of the at least one cathode separately from the flow of power to the at least one workpiece portion of the at least one cathode.

Aspects of the present invention also include a method of electroplating at least one metal on at least one substrate in an electroplating system including at least one plating tank containing a plating solution including the at least one metal to be plated on the at least one substrate. At least one anode is arranged in the at least one plating tank. The at least one anode is at least partially immersed within the plating solution during plating of the at least one metal. The system also includes at least one cathode including at least one workpiece portion in contact with the at least one substrate and at least one thief portion arranged in the vicinity of at least one portion of the at least one substrate for controlling plating of the at least one metal on the at least one portion of the at least one substrate. At least one power supply is connected to the at least one cathode. The method includes the step of decoupling a uniformity of the at least one metal deposited on the at least one substrate and the thickness of the at least one metal deposited on the at least one substrate.

Still other objects and advantages of the present invention will become readily apparent by those skilled in the art from the following detailed description, wherein it is shown and described only the preferred embodiments of the invention, simply by way of illustration of the best mode contemplated of carrying out the invention. As will be realized, the invention is capable of other and different embodiments, and its several details are capable of modifications in various obvious respects, without departing from the invention. Accordingly, the drawings and description are to be regarded as illustrative in nature and not as restrictive.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

As stated above, the present invention provides a method and apparatus for controlling uniformity of metal electroplated on substrates. According to the present invention, uniformity of metal may be controlled by decoupling metal uniformity from metal thickness in the electrodeposited metal. The required uniformity of metal plated on a substrate may vary from application to application.

For example, the optimum metal profile for CMP may require an electroplated metal to be deposited thicker at the periphery of a substrate rather than at the center of a substrate, or a concave metal profile. Alternatively, various processes including CMP may require the opposite, with the metal thicker at the center of a substrate as compared to the periphery, or a convex metal profile. The present invention makes it possible to create any desired metal profile by making uniformity of the deposited metal independent from thickness of the deposited metal.

Figure 1:
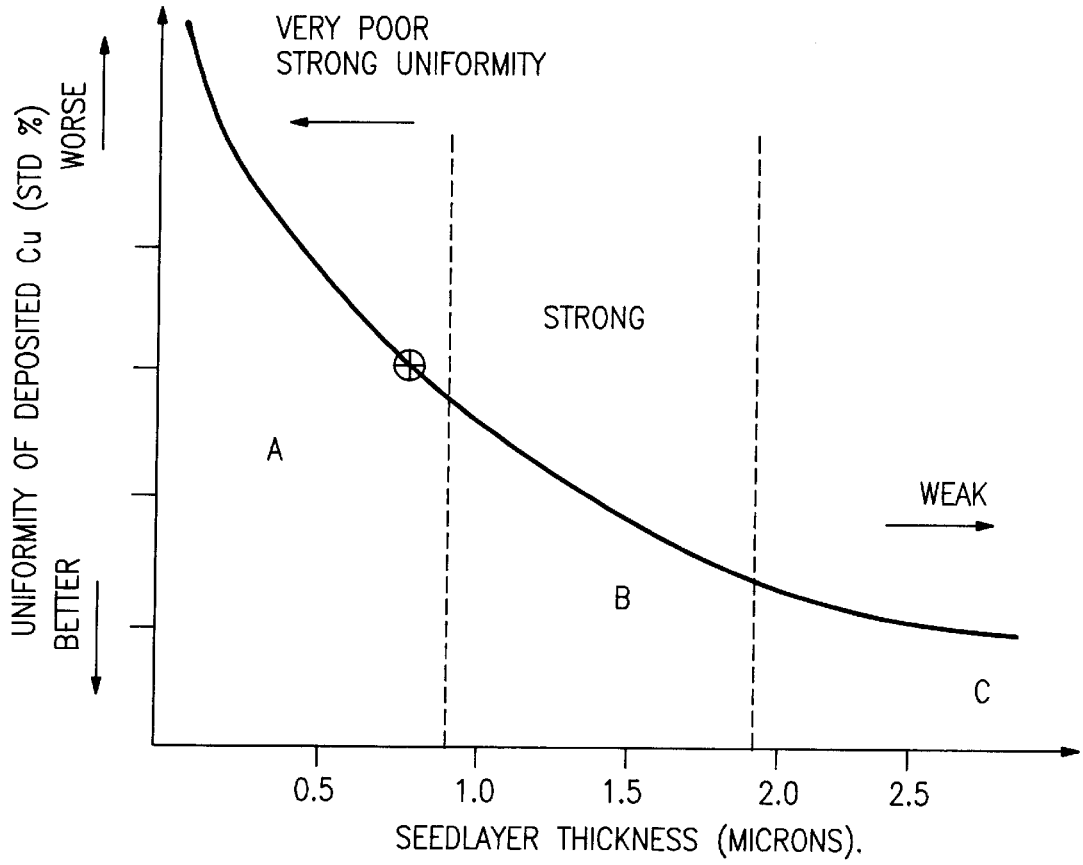
FIG. 1 represents a graph illustrating the uniformity distribution dependence on the thickness of an electroplated film on a large substrate.

FIG. 1 illustrates the relationship between the uniformity of electrodeposited copper expressed as the percent standard deviation with respect to average seed layer thickness. The results shown in FIG. 1 may be divided into three sections. In section A, the plated film is thinner than 700 nm. The effect of the seed layer thickness is very strong in this region. The standard deviation of the thickness, the measurement of uniformity in this case, is typically higher than about 8%. The uniformity degrades further as the thickness of the seed layer decreases.

In zone B, where the thickness of the deposited copper is from about 750 to about 1500 nm. The effect of the seed layer thickness on uniformity is intermediate to strong in this region.

In zone C, the thickness of the plated film is above about 1800 nm. In such cases, the impact of the seed layer tends to be weak.

FIG. 1 illustrates the dependence of uniformity distribution on the thickness of electroplated film on a substrate. In general, the thinner the seed layer, the worse the deposit uniformity. Conversely, the thicker the seed layer, typically the better the deposit uniformity. For seed layers thicker than about 250 nm, specifically for copper, the effect of the seed layer on deposit uniformity is weak.

Figure 2:
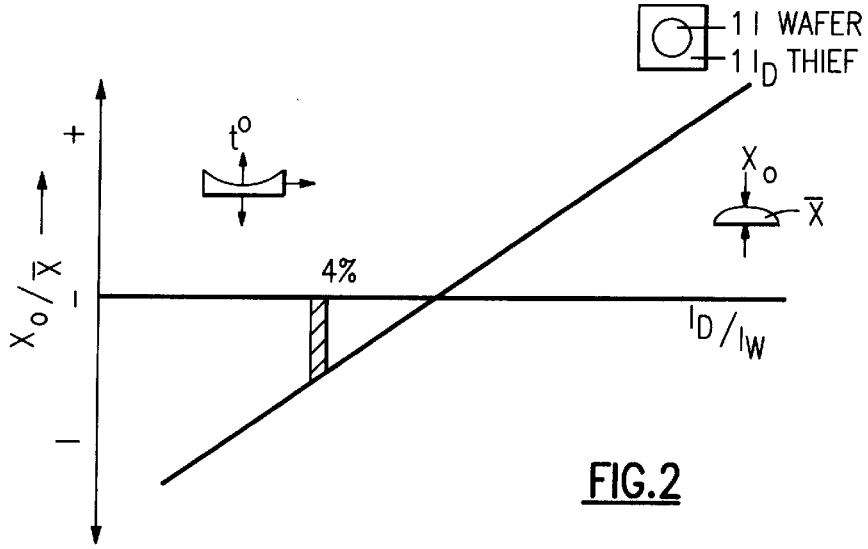
FIG. 2 represents a graph illustrating the effect of current density ratios Id/Iw on a profile of plated copper on a substrate.

The graph shown in FIG. 2 illustrates the relationship between the ratio of current density supplied to the cathode contacting a substrate that metal is being electroplated on ($I_D$) and current density supplied to the thief or deflector ($I_w$) with respect to the ratio of plated metal thickness at the wafer center ($X_o$) and mean plated metal thickness (X).

At the critical value for the ratio of current densities, the mean thickness is equal to the thickness at the center of the wafer, in other words, $X_o/X$ is equal to about one. At lower current density ratios, the deposit is thinnest at the center. In such an example, the ratio of thickness is less than about 1.0. The deposit profile in this case is concave.

For larger values of the current density ratio greater than the critical value, the deposit is thicker at the center. Therefore, $X_o$ is larger than X. In such a case, the deposit is concave.

Figure 3:
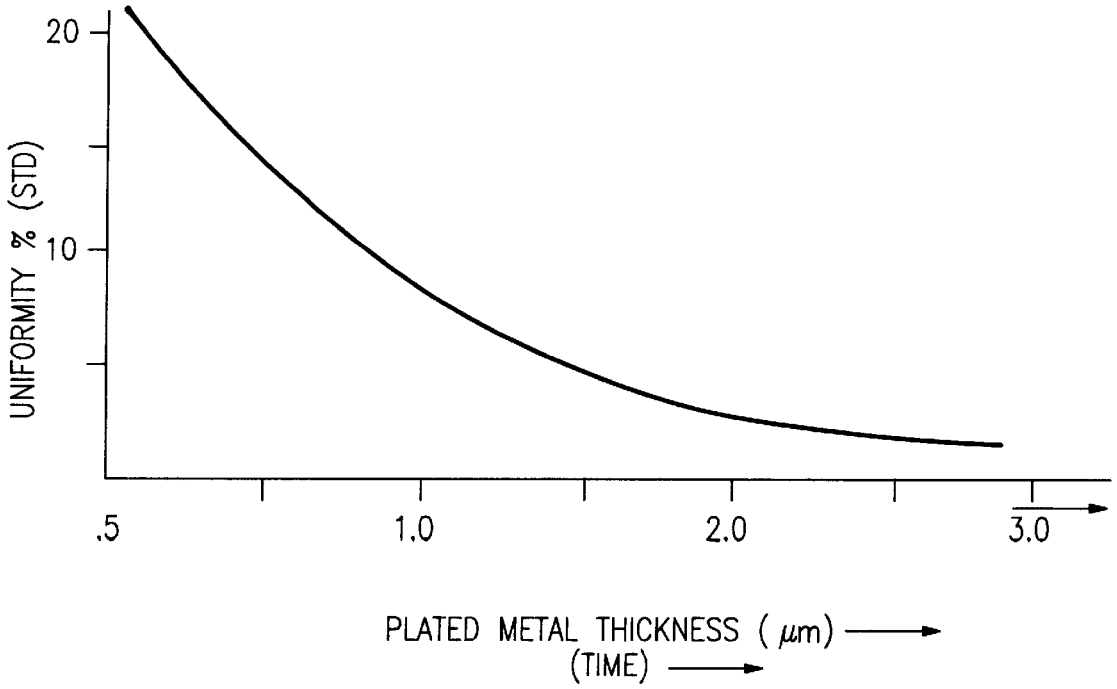
FIG. 3 represents a graph illustrating the effect of plated metal thickness on uniformity of a plated film.

FIG. 3 illustrates the effect of plated metal thickness on uniformity of plated film. Uniformity is again expressed as the percentage standard deviation. Plated metal thickness may also be alternately expressed as plating time since thickness typically increases with time in an electroplating system.

In the case shown in FIG. 3, a seed layer of about 50 nm was used. Initial uniformity at about 2,000 nm was about 4%. The plated metal profile was convex. The ratio of thickness at the wafer center and mean thickness was less than about 1.0.

Figure 4:
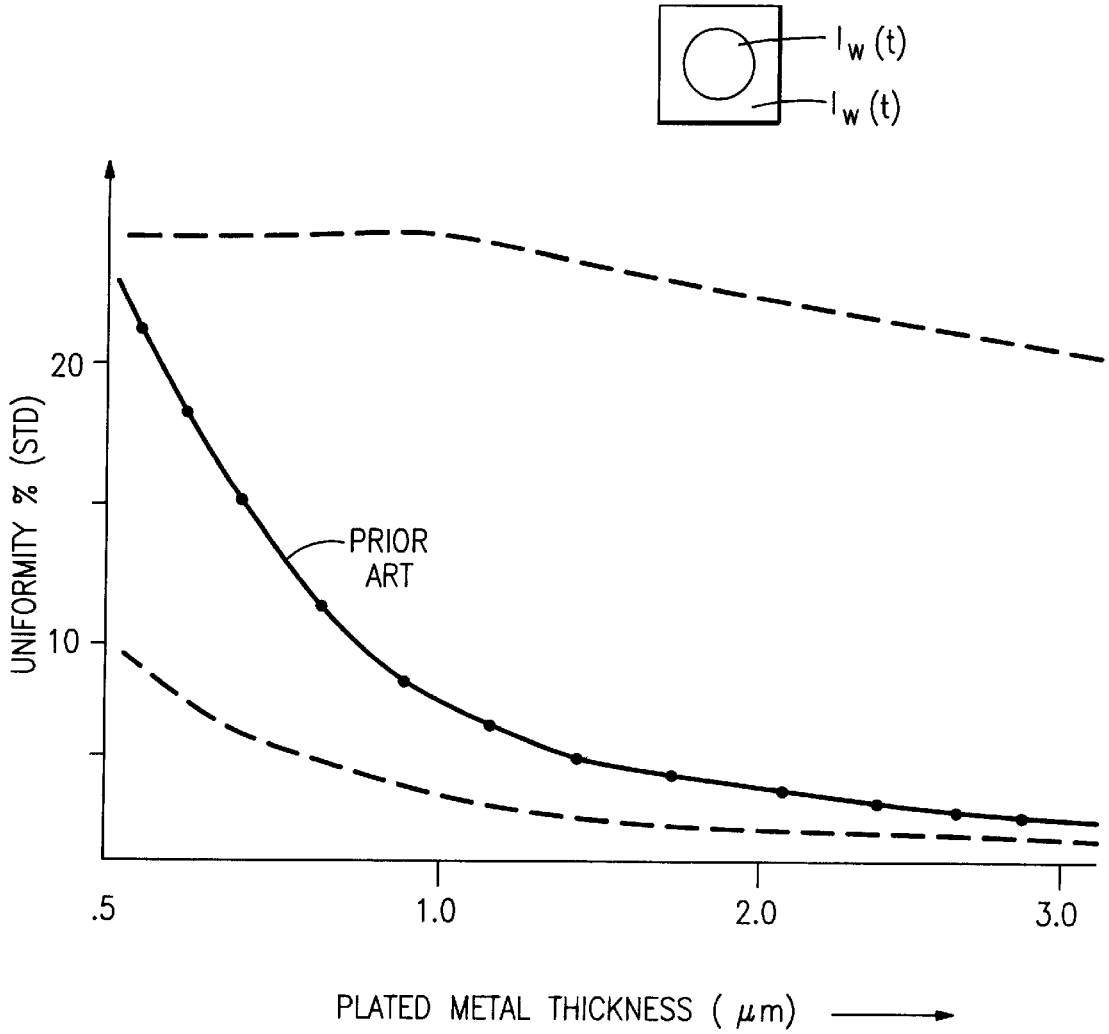
FIG. 4 represents a graph illustrating the effect of an embodiment of the present invention on the uniformity of electroplated metal deposited on a substrate.
Figure 5:
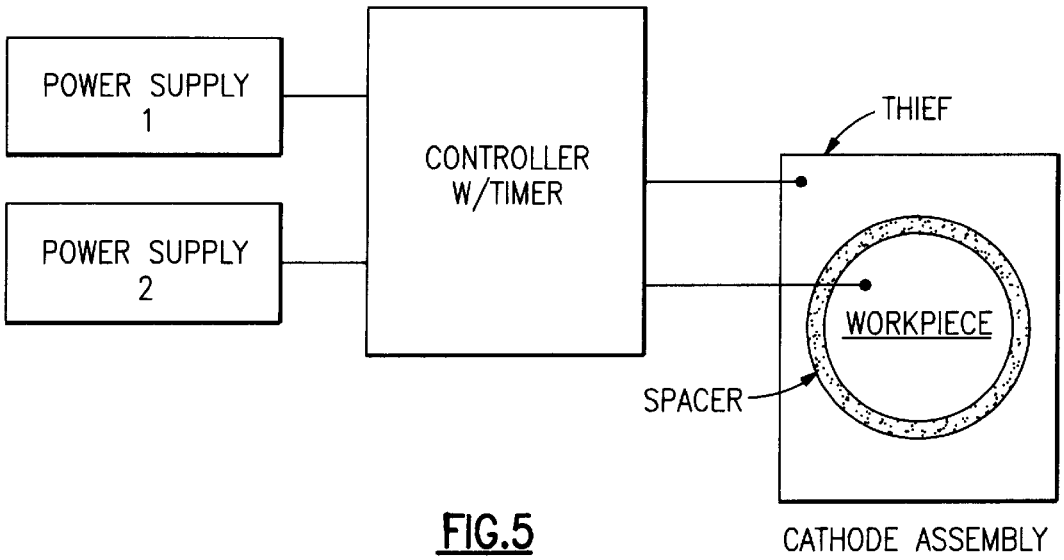
FIG.5 PRIOR ART
FIG. 5 schematically represents a known electroplating cell.
Figure 6:
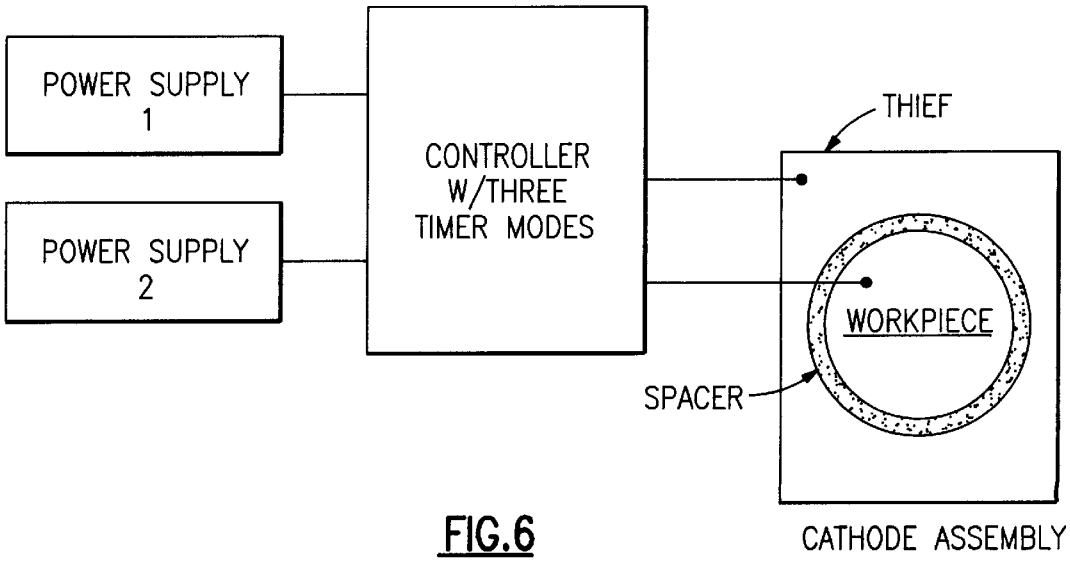
FIG. 6 schematically represents an embodiment of an electroplating cell according to the present invention.
Figure 7:
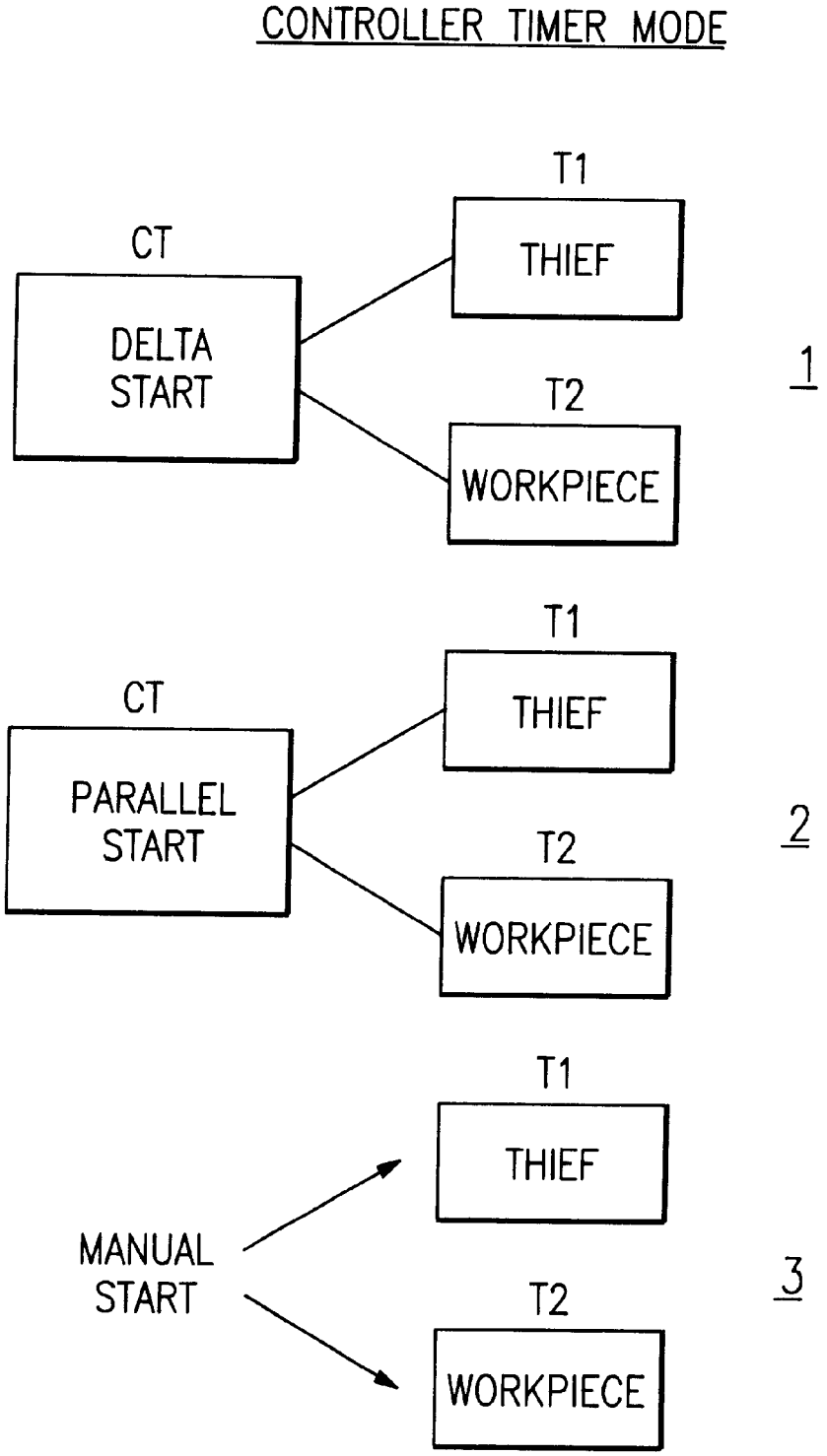
FIG. 7 illustrates three embodiments of timer control modes according to the present invention.

FIG. 4 illustrates the effect of an electroplating system according to the present invention including multiple timers for controlling uniformity of electrodeposited metal. The dotted line shown in FIG. 4 represents the profile for a single time control. The solid line represents the profile according to typical known electroplating system.

The top dashed line shown in FIG. 4 represents a profile of metal plated according to the present invention. Although the dashed line shown in FIG. 4 represents a much more consistent uniformity regardless of metal thickness, a range of uniformity is obtainable with an apparatus according to the present invention for any given metal thickness. The present invention permits deposit profile across a workpiece to be controlled according to CMP or metal etching needs.

For example, to obtain the best plating uniformity may require plating in the condition in which $x/x_o$ equals about 1 in FIG. 2. Depending on the area of the workpiece with respect to the thief, this best uniformity plating conditions may require $I_D/I_W$ to equal about 1.15. This current density on the thief is about 15% higher than that of the workpiece or wafer.

However, this typically applies only when the plating time for both the thief and the workpiece are about the same as in the prior art with single timer and controller. The present invention, which includes the use of separate time controllers for the thief and the workpiece, can increase metal deposition at the edge of the workpiece, simply by decreasing the length of time power is applied to the thief only. For example, for a plating time of about 300 seconds, the workpiece may be plated for about 300 seconds, while the thief may be plated for only about 240 seconds. Thus, by controlling the percentage of time the thief current is on, a much larger range of uniformity can be obtained, as shown in FIG. 4.

One of the problems of not tuning plating metal uniformity or profile to the needs of metal planarization is that a greater variation in line or via resistance across a wafer produces a correspondingly large variation in chip performance across the wafer. In addition to the problem of a large variation in chip performance, other defects may be caused by lack of uniformity or lack of controlled uniformity of plated metal are severe dishing, yield losses, shorts and leakages at subsequent metal levels, erosion of dielectric adjacent wide metal features, overpolishing among others. All of these problems can be attributed to the interplay between metal deposit uniformity and metal CMP. Various requirements involved in wafer production may require deposited metal to be thicker at the periphery, as compared to the center where they are reversed. Such requirements may include high wafer yield and narrow resistance distribution across a wafer. According to another example, optimum metals distribution may require excellent metal uniformity across an entire wafer.

Electroplating systems typically include a variety of arrangements to control electroplated metal uniformity. For example, typical arrangements may include anode and/or cathode shields, baffles, and/or thieves to control electroplated metal uniformity. To control electroplated metal thickness, typical systems rely on current density and plating time. Typical electroplating systems include a single timer to control metal deposition. As a result, uniformity of the deposited metal typically is related to deposit thickness on a thin seed layer, especially on large substrates.

To avoid problems existing in the prior art, the present invention utilizes an electroplating system that decouples plated metal uniformity and thickness. The present invention is effective whether utilizing a thin or thick metal seed layer and independent of the size of the substrate. To accomplish this goal, the present invention utilizes at least one controller for independently controlling flow of current and/or the characteristics of the current. The at least one controller may include a plurality of timers for controlling power flow to the electroplating system.

Accordingly, an electroplating system according to the present invention for plating at least one metal on at least one substrate may include at least one plating tank containing a plating solution including the at least one metal to be plated on the at least one substrate. At least one anode is provided in the at least one plating tank. The at least one anode is at least partially immersed within the plating solution during plating of the at least one metal.

The electroplating system also includes at least one cathode. The at least one cathode includes at least two separate portions. In particular, the at least one cathode includes at least one workpiece portion. The at least one workpiece portion contacts the at least one substrate and provides current thereto so as to result in the electroplating of the at least one metal on the at least one substrate.

The at least one cathode also includes at least one thief portion for controlling plating of the at least one metal on at least a portion of the at least one substrate. Typically, the at least one thief portion of the at least one cathode is arranged in the vicinity of at least one portion of a substrate that at least one metal is to be plated on. As the thief is supplied with current, metal plates out of the solution on to the thief rather than the substrate.

At least one power supply is connected to the at least one cathode, including the workpiece portion of the cathode and the thief portion of the cathode. At least one controller separately controls flow of power to the at least one cathode. In other words, the at least one controller supplies power and may also vary the characteristics of the power supplied to the at least one workpiece portion of the cathode separately from the at least one thief portion of the cathode.

One purpose of the present invention is to control a current output level directed to the two portions of the cathode prior to application of the current to the at least one cathode. Hence, the at least one controller may include at least one component for separately varying the characteristics of the current supplied to portions of the at least one cathode. The at least one controller may also include at least one electronic timer for separately controlling the duration of the application of current to portions of the at least one cathode. Accordingly, the at least one power supply may be interconnected with the electroplating system through timers for controlling the duration of the application of the power.

According to one embodiment, the present invention includes three timers. A first timer controls duration of application of power to the at least one workpiece cathode and, hence, controls metal deposited on the at least one substrate. A second timer controls a duration of application of power to the thief portion of the cathode. A third timer may be utilized to offset the starting time of the second timer. For example, the third timer may delay the starting of the second timer.

By controlling the three timers, the present invention may decouple electroplated metal deposit uniformity and metal thickness. Such an embodiment has been utilized to electroplate copper in the range of from about 500 to about 3,000 nm and even thicker with a uniformity of about 12%.

The present invention may include at least one separate power supply for each cathode portion, at least one separate timer for controlling flow of power through each separate cathode portion and/or at least one separate element for controlling characteristics of the power, such as current density, supplied to each separate portion of the at least one cathode. However, it is only necessary that the present invention include separate timers for independently controlling flow of power to the cathode portions. The present invention may also include a pulse timer or programmable pulse timer to control flow of power to the thief portion of the cathode. Furthermore, multiplex timers may be utilized for controlling metal distribution on a workpiece.

Another embodiment of the present invention includes two timer sections. Each timer section may include a pair of timers. Each timer section may also include an operating switch, such as a toggle switch. The two timer sections may be identified as T1 and T2. The pair of timers may include one timer for minutes and one timer for seconds. The controller may include other controls including a main power switch/circuit breaker, a start/reset button, a mode switch, to control at the mode of operation, which will be discussed in greater detail below, and a delta mode timer.

Internally, this embodiment of the control system of the present invention for controlling uniformity of electroplated metal(s) in an electroplating system may include, of course, the timers. Additionally, the present invention may include at least one relay. According to one example, the control system includes three relays, a first relay that is a control relay, and two output relays. The two output relays may include snubber type networks across the contacts to limit voltage spiking to the electroplating system when a change of state in the relays occurs.

This embodiment of the timer includes a plurality of outputs for supplying power to various portions of the electroplating system. The output of each power supply may be initiated by the start/reset button. According to one embodiment, when the start/reset button is closed, the timing circuit becomes active. The timers may be illuminated to indicate that they are operational. The timers may be illuminated and, hence, power supplied to them, until the start/reset button is pushed again. Pushing the start/reset button again may reset the control and turn the power off. When the start/reset button is in a reset position or off position, the timers may not be illuminated.

The duration that the timers permit power to be supplied to various portions of the electroplating system, such as various cathode portions, may be set by knobs on each timer unit. According to one embodiment, once the timers are started, they begin to count down the time period while simultaneously supplying power to various portions of the electroplating system. When time has run out on a timer, the control system may be in a "time out" standby mode until the start/reset button is again operated to deactivate or reset the control system. According to this embodiment, the start/reset button may be operated again to provide power to the timers so that they may be "reset" and begin another countdown sequence.

Of course, those skilled in the art would know a variety of ways to configure and construct a control system according to the present invention once aware of the basic concept of the present invention.

Regardless of the elements included in the hardware of an electroplating system/control system according to the present invention, the present invention may be operated in a variety of modes. According to perhaps the simplest method, the present invention may be manually operated. In other words, each timer of the control system may be set and energized separately. The timers may be turned on and off manually.

According to another mode of operating the present invention, each timer may simultaneously be supplied with power and supplies the electroplating system with power. In the embodiment described above that includes separate seconds and minutes timers, when the power is supplied to the timers only the minutes portion of the timers may be supplied with power. At the end of the programmed number of minutes, the second timers may be energized to supply the electroplating system with power for the programmed number of seconds. After the seconds are counted down on the timer, the power may be cut off from the electroplating system.

In the embodiment described above, the two output relays may be controlled by the application of power to the minutes timers. After the minutes timers count down, a set of timed contacts energize the second timers. When the second timers are finished counting down, a set of contacts may open. Opening of the contacts at the end of the second timers count down de-energizes relays supplying power to the system, thus cutting off power to the system.

According to a third mode of operation, the present is invention may include an additional timer to offset the starting of one timer section, typically the timer controlling output power to the thief cathode. When power is supplied to the control system, power may be supplied to the minute timer of the first timer section in the embodiment described above. Simultaneous with activation of the minute timer, one of the output relays may be energized. At this point in the operation of the electroplating system, output is supplied only to the tool through one power supply by way of the first relay. When the minute timer expires, the second relay becomes energized, supplying power to the electroplating cell through the second relay.

The present invention includes an electroplating system and a control system for controlling an electroplating system. The present invention also includes methods of electroplating at least one metal on a substrate. The methods according to the present invention may include providing an electroplating system as described above.

According to the methods of the present invention, the flow of power to portions of the at least one cathode are separately controlled. All parameters relating to the flow of power may be controlled. For example, the current density and time period during which power is supplied to the portions of the cathode may be controlled.

Power may be supplied in various current densities for various time periods to each portion of the cathode of the electroplating system. Power may be supplied to each portion of the cathode for multiple time periods at multiple current densities to achieve desired characteristics of the plated metal. According to one example, flow of power to the thief portion of the cathode may be delayed to a point in time after power has been supplied to the at least one workpiece portion of the cathode.

Preferably, the characteristics of the current and time periods are selected to achieve a desired predetermined plating uniformity. Additionally, preferably, the electroplating is controlled such that the uniformity of the at least one metal deposit on the at least one substrate and the thickness of the at least one metal deposited on the at least one substrate are decoupled.

Another method to control the decoupling of the workpiece and thief or deflector plating times, may be by the use of a Programmable Logic Controller, or PLC as they are sometimes called. This configuration could be used in place of the above disclosed discreet timer controls.

Any other arrangements, configurations, or physical layouts, or hardware layouts, software and software controls, or any combination or combinations thereof, which are used to independently or separately control the plating times of the workpiece with respect to the thief, or deflector may also be utilized according to the present invention. Any configurations of hardware or software that can be used to mimic or achieve the independent control of the plating time of the workpiece with respect to the thief may also be utilized according to the present invention.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

We claim:

1. An electroplating system for plating at least one metal on at least one substrate, said electroplating system comprising:

at least one plating tank containing a plating solution including said at least one metal to be plated on said at least one substrate;

at least one anode arranged in said at least one plating tank, said at least one anode being at least partially immersed within said plating solution during plating of said at least one metal;

at least one cathode including at least one workpiece portion in contact with said at least one substrate, said at least one cathode also including at least one thief portion arranged adjacent said at least one workpiece portion and adjacent at least one portion of said at least one substrate, said at least one workpiece portion and said at least one thief portion controlling plating of said at least one metal on said at least one portion of said at least one substrate;

at least one power supply connected to said at least one cathode; and at least one controller separately controlling a flow of power to said at least one workpiece portion of said cathode and said at least one thief portion of said cathode, said at least one controller includes a first timer for controlling a flow of power to said workpiece portion of said at least one cathode and said at least one substrate, and a second timer for controlling a flow of power to said at least one thief portion of said at least one cathode.

2. The electroplating system according to claim 1, wherein said at least one controller includes a first timer for controlling a flow of power to said workpiece portion of said at least one cathode and said at least one substrate, and a second timer for controlling a flow of power to said at least one thief portion of said at least one cathode.

3. The electroplating system according to claim 1, further comprising:

a third timer for controlling a flow of power to said second timer.

4. The electroplating system according to claim 3, wherein said third timer delays the flow of power to said at least one thief portion of said at least one cathode to a point in time after power has been supplied to said at least one workpiece portion of said at least one cathode and said at least one substrate.

5. A control system for controlling uniformity of electroplating of at least one metal on at least one substrate in an electroplating system including at least one plating tank containing a plating solution including said at least one metal to be plated on said at least one substrate, at least one anode arranged in said at least one plating tank, said at least one anode being at least partially immersed within said plating solution during plating of said at least one metal, at least one cathode including at least one workpiece portion in contact with said at least one substrate, said at least one cathode also including at least one thief portion arranged adjacent said at least one workpiece portion and adjacent at least one portion of said at least one substrate, said at least one workpiece portion and said at least one thief portion controlling plating of said at least one metal on said at least one portion of said at least one substrate, at least one power supply connected to said at least one cathode, said control system comprising:

at least one controller separately controlling a flow of power to said at least one workpiece portion of said at least one cathode and said at least one thief portion of said at least one cathode, said at least one controller includes a first timer for controlling a flow of power to said workpiece portion of said at least one cathode and said at least one substrate, and a second timer for controlling a flow of power to said at least one thief portion of said at least one cathode.

6. The control system according to claim 5, wherein said electroplating system further includes a power supply for each portion of said cathode.

7. The control system according to claim 5, further comprising:

a third timer for controlling a flow of power to said second timer.

8. The control system according to claim 7, wherein said third timer delays the flow of power to said at least one thief portion of said at least one cathode to a point in time after power has been supplied to said at least one workpiece portion of said at least one cathode and said at least one substrate.

9. An electroplating system for plating at least one metal on at least one substrate, said electroplating system comprising:

at least one plating tank containing a plating solution including said at least one metal to be plated on said at least one substrate;

at least one anode arranged in said at least one plating tank, said at least one anode being at least partially immersed within said plating solution during plating of said at least one metal;

at least one cathode including at least one workpiece portion in contact with said at least one substrate, said at least one cathode also including at least one thief portion arranged adjacent said at least one workpiece portion and adjacent at least one portion of said at least one substrate, said at least one workpiece portion and said at least one thief portion controlling plating of said at least one metal on said at least one portion of said at least one substrate;

at least one power supply connected to said at least one cathode;

at least one controller separately controlling a flow of power to said at least one workpiece portion of said cathode and said at least one thief portion of said cathode; and a power supply for each portion of said cathode.

10. A control system for controlling uniformity of electroplating of at least one metal on at least one substrate in an electroplating system including at least one plating tank containing a plating solution including said at least one metal to be plated on said at least one substrate, at least one anode arranged in said at least one plating tank, said at least one anode being at least partially immersed within said plating solution during plating of said at least one metal, at least one cathode including at least one workpiece portion in contact with said at least one substrate, said at least one cathode also including at least one thief portion arranged adjacent said at least one workpiece portion and adjacent at least one portion of said at least one substrate, said at least one workpiece portion and said at least one thief portion controlling plating of said at least one metal on said at least one portion of said at least one substrate, at least one power supply connected to said at least one cathode, said control system comprising:

at least one controller separately controlling a flow of power to said at least one workpiece portion of said at least one cathode and said at least one thief portion of said at least one cathode; and a power supply for each portion of said cathode.

11. An electroplating system for plating at least one metal on at least one substrate, said electroplating system comprising:

at least one plating tank containing a plating solution including said at least one metal to be plated on said at least one substrate;

at least one anode arranged in said at least one plating tank, said at least one anode being at least partially immersed within said plating solution during plating of said at least one metal;

at least one cathode including at least one workpiece portion in contact with said at least one substrate, said at least one cathode also including at least one thief portion arranged adjacent said at least one workpiece portion and adjacent at least one portion of said at least one substrate, said at least one workpiece portion and said at least one thief portion controlling plating of said at least one metal on said at least one portion of said at least one substrate;

at least one power supply connected to said at least one cathode; and at least one controller separately controlling a flow of power to said at least one workpiece portion of said cathode and said at least one thief portion of said cathode, said at least one controller includes at least one timer for controlling a flow of power to each of said portions of said at least one cathode.

12. A control system for controlling uniformity of electroplating of at least one metal on at least one substrate in an electroplating system including at least one plating tank containing a plating solution including said at least one metal to be plated on said at least one substrate, at least one anode arranged in said at least one plating tank, said at least one anode being at least partially immersed within said plating solution during plating of said at least one metal, at least one cathode including at least one workpiece portion in contact with said at least one substrate, said at least one cathode also including at least one thief portion arranged adjacent said at least one workpiece portion and adjacent at least one portion of said at least one substrate, said at least one workpiece portion and said at least one thief portion controlling plating of said at least one metal on said at least one portion of said at least one substrate, at least one power supply connected to said at least one cathode, said control system comprising:

at least one controller separately controlling a flow of power to said at least one workpiece portion of said at least one cathode and said at least one thief portion of said at least one cathode, said at least one controller includes at least one timer for controlling a flow of power to each of said portions of said at least one cathode.

* * * * *